US008714184B1

(12) United States Patent
Florek

(10) Patent No.: US 8,714,184 B1
(45) Date of Patent: May 6, 2014

(54) CAGED BALL AND SPRING VALVE ROTATOR

(76) Inventor: Bronislaw B. Florek, Dousman, WI (US)

( * ) Notice: Subject to any disclaimer, the term of this patent is extended or adjusted under 35 U.S.C. 154(b) by 145 days.

(21) Appl. No.: 13/398,940

(22) Filed: Feb. 17, 2012

Related U.S. Application Data

(60) Provisional application No. 61/463,460, filed on Feb. 17, 2011.

(51) Int. Cl.
*F01L 1/32* (2006.01)

(52) U.S. Cl.
USPC ..... 137/311; 123/90.13

(58) Field of Classification Search
USPC ..... 251/56; 123/90.28, 90.29, 188.1, 190.1; 137/331, 330
See application file for complete search history.

(56) References Cited

U.S. PATENT DOCUMENTS

| | | | | |
|---|---|---|---|---|
| 2,855,913 | A | 10/1958 | Geer | |
| 3,890,943 | A | 6/1975 | Schonlau et al. | |
| 3,892,210 | A | 7/1975 | Kuhn et al. | |
| 4,075,987 | A | 2/1978 | Tauschek et al. | |
| 4,094,280 | A | 6/1978 | Updike | |
| 4,141,325 | A | 2/1979 | Shalaty | |
| 4,154,424 | A | 5/1979 | Cherrie | |
| 4,227,493 | A | 10/1980 | Updike | |
| 4,425,882 | A | 1/1984 | Updike et al. | |
| 4,538,558 | A | 9/1985 | Updike et al. | |
| 4,597,408 | A | 7/1986 | Canter | |
| 5,727,507 | A | 3/1998 | Johansson | |
| 6,662,770 | B2 | 12/2003 | Engesser | |
| 7,997,243 | B2 | 8/2011 | Florek | |
| 2009/0272344 | A1* | 11/2009 | Florek | 123/90.3 |

FOREIGN PATENT DOCUMENTS

| | | |
|---|---|---|
| JP | 11-324619 | 11/1999 |

* cited by examiner

*Primary Examiner* — John Rivell
*Assistant Examiner* — Kevin Barss
(74) *Attorney, Agent, or Firm* — Boyle Fredrickson, S.C.

(57) ABSTRACT

An improved ball type valve rotator is provided that includes a ball cage that may include an inner flange and outer walls that are connected to opposing inner and outer portions of a middle flange from which multiple ramps extend. The inner flange and outer walls may define respective boundaries of pockets that hold bearing balls and springs so that the bearing balls and springs are transversely confined between components that may be formed from a single piece of material.

10 Claims, 4 Drawing Sheets

CAGED BALL AND SPRING VALVE ROTATOR

CROSS REFERENCE TO RELATED APPLICATIONS

This application claims priority under 35 U.S.C. §119(e) to U.S. Provisional Patent Application Ser. No. 61/463,460, filed on Feb. 17, 2011, the entirety of which is expressly incorporated by reference herein for all purposes.

BACKGROUND OF THE INVENTION

1. Field of the Invention

This invention relates to internal combustion engine valvetrain components and, more particularly, to valve rotators.

2. Discussion of the Related Art

Valve rotators are commonly used in some internal combustion engines to provide positive valve rotation during each cycle of an opening phase of engine valve actuation. It is known and appreciated that even slight rotation of a valve during use can increase engine service intervals and extend valvetrain use life by, e.g., minimizing burning and guttering type wear of valves, reducing thermal differentials across each individual valve, reducing carbon buildup on the valves, promoting valve stem lubrication, and/or other benefits.

Known valve rotators are typically classified as being either garter type valve rotators or bearing ball rotators which are commonly referred to as ball type valve rotators. Both garter and ball type valve rotators can be installed in place of a valve spring retainer on the top of a valve spring, or as an additional valvetrain component installed under a valve spring. In either case, whether used as a supplemental valvetrain component, or a replacement component, the valve rotators function by, e.g., utilizing energy associated with valve spring compressive forces and converting such energy into rotational movement of a rotator body within a rotator housing and correspondingly rotating the valve itself.

Typical garter and ball type valve rotators have disadvantages. Garter type valve rotators typically include garter springs of garter type valve rotators are made from relatively small diameter spring material. Correspondingly, the garter springs can have a relatively short use life due to, e.g., exposure to various fatigue forces, loading and unloading at a high rate of recurrence or frequency, temperature cycling between periods of use and non-use, and/or other factors or stresses endured during use. Ball type rotators typically include rigid pockets that hold the bearing balls. In the dynamically changing high stress and load environment in which valve rotators operate, the forces that are applied to the valve rotators are rarely evenly distributed about the rotator body and/or housing, whereby valve rotator bodies and/or housings are subjected to highly localized applications of the input forces. The bearing ball(s) nearest such localized application of force therefore bears relatively more stress of the input force and carry more or even a majority of the load, as compared to the other bearing balls. This can create point loading between such bearing balls and the spring disk with sufficiently great force to create pitting in, or wear grooves into, the spring disk which can shortening its use life.

The applicant's own U.S. Pat. No. 7,997,243 addresses such problems by providing improved ball type valve rotators having multiple ramps that can independently flex with respect to each other to accommodate non-uniform applications of force into the valve rotator.

SUMMARY OF THE INVENTION

The applicant has recognized that, although the ball type valve rotators of his U.S. Pat. No. 7,997,243 are suitable for their intended purpose, it may be desirable to make further improvements to ball type valve rotators. The present invention provides a ball type valve rotator that may be implemented without separate outer and/or inner rings to transversely confine bearing balls and springs within pockets of a ball cage assembly. The pockets of the ball cage assembly may be defined between walls or other components of a ball cage itself, such as an inner flange and outer walls on opposing sides of the pockets that are directly connected to a part of the ball cage from which multiple ramps extend. The confining walls of the pocket and the ramps that extend into the pockets may therefore be different segments of the same ball cage assembly. This may reduce clearance variations between different portions of the pocket which may improve how securely the bearing ball and spring is held within each of the pockets. A hardened ring may be provided between the ball cage assembly and other components of the valve rotator, such a spring disk, which facilitates sliding between such components while reducing wear.

According to one aspect of the invention, a valve rotator is provided for use with a valve of an internal combustion engine. The valve rotator includes a main body segment and a body cap overlying the main body segment and a space is defined between the main body segment and the body cap. A ball cage assembly is housed in the space between the main body segment and the body cap. The ball cage assembly may be made as a formed component from a single blank made from a spring-type sheet metal. The ball cage assembly may include a middle flange having a generally ring-shaped profile defined between an inner perimeter and an outer perimeter of the middle flange and opposing upper and lower surfaces. Multiple ramps may be provided that are spaced from each other and extend upwardly from the upper surface of the middle flange between the inner and outer perimeters of the middle flange. The ramps may be stamped into the middle flange. The stamped ramps may be defined by convex wedge-shaped surfaces extending from the upper surface of the middle flange. At the lower surface of the middle flange, the ramps extend inwardly with respect to the lower surface to define concave surfaces that have been created by a stamping die that formed the ramps and therefore correspond to the shape of the ramps.

According to another aspect of the invention, multiple outwardly disposed strips which may define wall assemblies are connected to and extend upwardly from the outer perimeter of the middle flange. The multiple wall assemblies are circumferentially spaced from each other about the middle flange. Each of the multiple wall assemblies may include an outer wall and an end wall. The end wall may be attached to and extend generally orthogonally from the outer wall, whereby each wall assembly may define an L-shaped perimeter when viewed from above. In this way, the end wall may extend in a generally radial direction across the middle flange. The outer wall may have an inner surface that faces inwardly toward the middle flange and an outer surface that faces outwardly away from the middle flange. At least a portion of the end wall of each of the multiple wall assemblies extends to a greater height than the respective outer wall. The end wall segment may include a curved upper perimeter edge which may present a convex edge that defines the relatively greater height when compared to the outer wall.

According to another aspect of the invention, the ball cage assembly further may include an inner flange that extends from the inner perimeter of the middle flange and upwardly away from the upper surface of the middle flange. The inner flange may include multiple tabs that extend upwardly from the remainder of the inner flange. The tabs of the inner flange may include upper ends that extend angularly away from the middle flange and toward a central axis of the valve rotator. A ring may be provided that sits upon the upper ends of the inner flange of the ball cage assembly so that the ring is sandwiched between the inner flange of the ball cage assembly and a spring disk that is housed in the space that is defined between the main body segment and the body cap. Such ring may provide an interface between the disk spring and the ball cage assembly that has relatively less friction than would be present in a direct ball cage assembly to disk spring interface so as to facilitate rotational and/or other sliding of such components relative to each other.

According to another aspect of the invention a pocket may be defined between the ball cage assembly inner flange and each of the multiple wall assemblies. The pocket houses a bearing ball that is spring biased and cooperates with the other components of the valve rotator to provide rotation of the valve. Movement of the bearing ball in a radial direction inwardly across the middle flange is limited by the inner flange. Movement of the bearing ball in a radial direction outwardly across the middle flange is limited by the outer wall of the respective wall assembly. This may allow the bearing ball to be confined within the ball cage assembly in a manner that eliminates a need for an outer retaining ring provided concentrically outside of the ramps.

According to another aspect of the invention, the spring that biases the ball bearing is arranged within pocket(s) so that a first end of the spring engages an end wall of a first wall assembly and a second end of the spring engages the respective ball bearing and biases the ball bearing against an end wall of a second wall assembly. Each end wall of the wall assemblies may include a depression into which the ball bearing is biased in a resting state of the valve rotator. The depression may be a concavity or dish stamped into the end wall, whereby an opposing side of the end wall segment may have a convex bulge extending from such opposing side of the end wall. The depression may help locate the ball bearing in the resting state and the convex bulge may help locate a circular end of a spring concentrically seated thereabout.

According to another aspect of the invention, a lower leg interconnects the outer wall of the wall assembly to the middle flange of the ball cage assembly. A length of the lower leg may be less than, for example, about one-half of, the length of the outer wall of the wall assembly. The outer wall may be connected to the middle flange only through the lower leg, whereas the rest of the outer wall is spaced from the middle flange. The end wall may be connected to a portion of the outer wall that is spaced from the lower leg. The end wall may extend over and be vertically spaced from the middle flange.

According to another aspect of the invention, the at least a portion of the end wall of each of the multiple wall assemblies extends to a greater height than the respective outer wall. The end wall segment may include a curved upper perimeter edge which may present a convex edge that defines the relatively greater height when compared to the outer wall.

According to another aspect of the invention, the ball cage may be made from a single blank of spring-type sheet metal material. The blank may be annealed into a soft annealed state. Then the blank may be stamped into its ready to use form while in the soft annealed state. Once the blank has been stamped into its ready to use form, the formed blank may be heat treated to harden the material so that the ball cage is used in a hardened state.

Various alternative embodiments and modifications to the invention will be made apparent to one of ordinary skill in the art by the following detailed description taken together with the drawings.

BRIEF DESCRIPTION OF THE DRAWINGS

The drawings illustrate a preferred and exemplary embodiment of the invention.

In the drawings.

DETAILED DESCRIPTION OF THE PREFERRED EMBODIMENTS

The present invention and the various features and advantageous details thereof are explained more fully with reference to the non-limiting embodiments described in detail in the following description.

Figure 1:
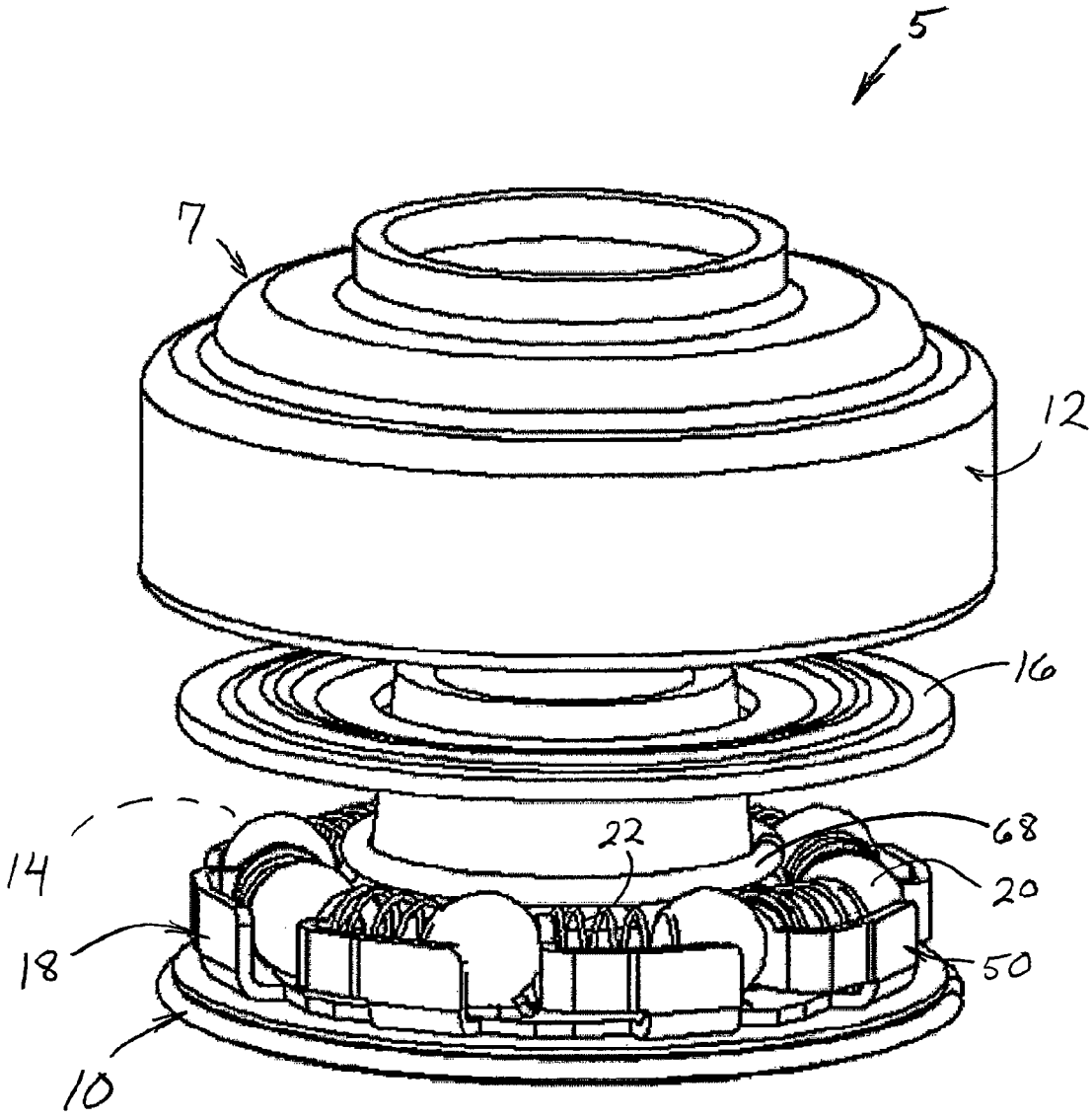
FIG. 1 is an exploded perspective view of a valve rotator 5 in accordance with the invention.

Turning now to the drawings, FIG. 1 shows an implementation of a ball type valve rotator of the invention, e.g., valve rotator 5, which can be incorporated into valvetrains of internal combustion engines. Valve rotator 5 is attached to valves (not shown), e.g., upon valve stems, and can be installed in any of a variety of places and manners upon the valves. For example, valve rotator 5 can be installed in place of or in addition to a valve spring retainer on the top of a valve spring. In other implementations, the valve rotator 5 can be installed under the valve spring. Regardless of whether it is implemented as a supplemental or replacement component in the valvetrain, the valve rotator 5 is configured to, e.g., utilize energy associated with valve spring compressive forces and convert such energy into rotational movement(s) of the valve itself. Stated another way, during use, a valve reciprocates the valve rotator 5 to incrementally rotationally advances or re-indexes the valve within its seat so that the valve and/or valve seat wear in a relatively more uniform fashion.

Still referring to FIG. 1, valve rotator 5 includes a housing assembly 7 having a main body segment 10 and a body cap 12 overlying it to define a space 14 therebetween and in which a spring disk 16 is housed. The main body segment, body cap 12, and spring disk 16 may be substantially identical to those described in Applicant's U.S. Pat. No. 7,997,243 which is incorporated herein by reference.

Figure 2:
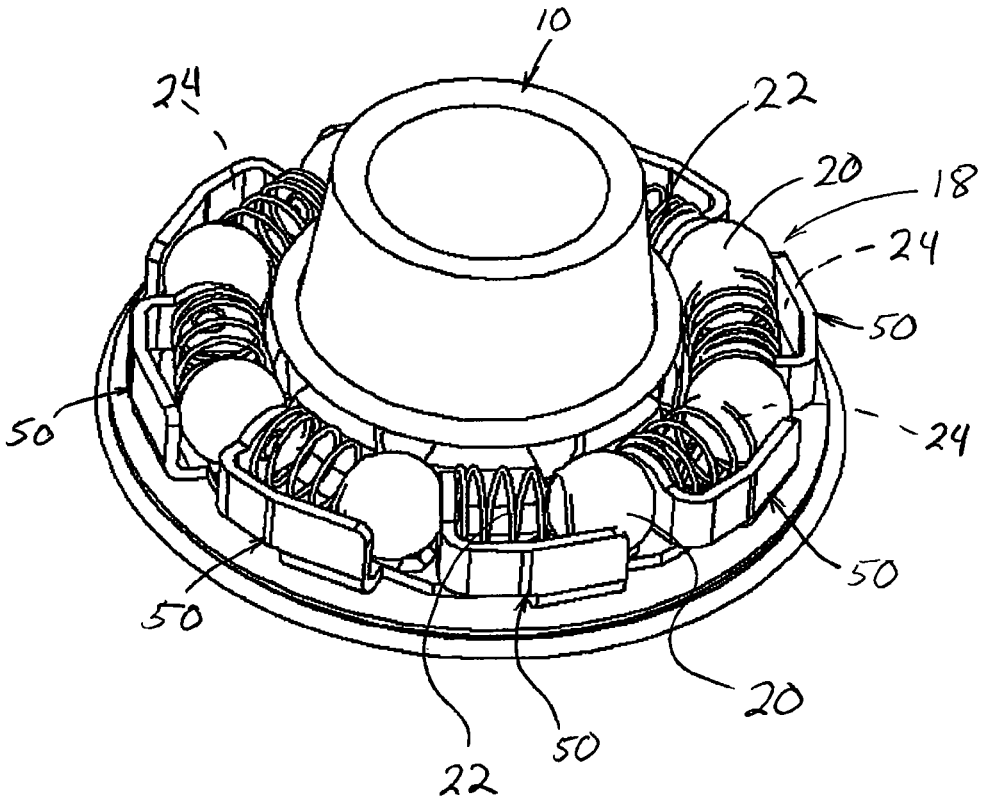
FIG. 2 is a perspective view of a portion of a portion of the valve rotator of FIG. 1.

Still referring to FIG. 1, the space 14 between the main body segment 10 and body cap 12 also houses a ball cage assembly 18. As shown in FIGS. 1 and 2, the ball cage assembly 18 includes bearing balls 20 and springs 22 that are held within respective pockets 24 of a ball cage 26. Springs 22 are shown as being helical compression springs but it is understood that springs 22 may be other resilient members that are capable of biasing the bearing balls 20 in a longitudinal direction through the pockets 24. The ball cage 26 of this embodiment is configured so that the bearing balls 20 and springs 22 are maintained in the pockets 24 without requiring ancillary outer retaining rings or inner retaining rings to transversely locate and guide movement of the bearing balls 20 and springs 22 within the pockets 24.

Figure 3:
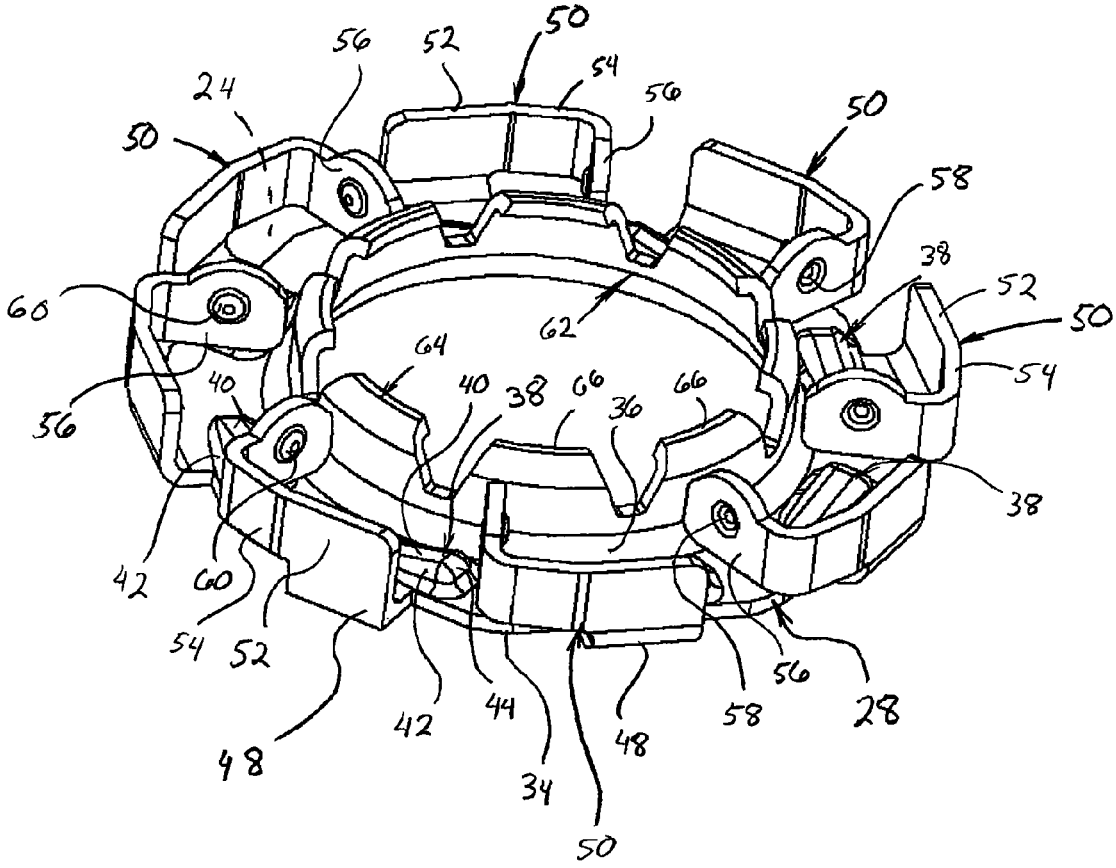
FIG. 3 is a pictorial view of a ball cage of the valve rotator of FIG. 1.

Referring now to FIG. 3, the ball cage 26 is made from a spring-type sheet metal material and includes a middle flange 28 that is generally ring-shaped. The middle flange 28 has and upper surface 30, an opposing lower surface 32, an outer perimeter 34, and an inner perimeter 36. Multiple ramps 38 are formed into the middle flange 28, between the outer and inner perimeters 34, 36. The ramps 38 may be formed by a stamping procedure which stamps the ramps 38 from below the lower surface 32 to displace material of the middle flange 28 upwardly. This can produce concave depressions that extend into the lower surface 32 of the middle flange 28. In a corresponding way, the ramps 38 extend upwardly as convex projections from the upper surface 30 of the middle flange 28. Since the ball cage 26 is made from a spring-type sheet metal material, each ramp 38 can deflect in a spring-like manner downwardly independently of each other so as to accommodate non-uniform applications of force into the valve rotator 5 (FIG. 1) by deflecting downwardly different distances as a function of different amounts of force at different locations upon the valve rotator 5. The ramps 38 as shown in FIG. 3 have sloped top wall 40 and interconnected ramp side walls 42 and ramp end walls 44. In other embodiments, the stamping procedures that forms the ramps 38 shears the connection between the upper most end of the ramp sloped top wall 40 and material of the middle flange 28 to which it was connected so as to leave an opening between the upper most end of the ramp sloped top wall 40 and the middle flange 28, instead of a ramp end wall 44. In another embodiment, part of the ramp side wall 42 is sheared or otherwise detached from the middle flange 28 so as to allow the sloped top wall 40 to bend more easily while deflecting during use.

Still referring to FIG. 3, from the outer perimeter 34 of the middle flange 28, walls which can be provided as strips of material as unitary extensions of the middle flange 28 can define wall assemblies 46 that define the outermost boundaries of the pockets 24. Each wall assembly 46 includes a lower leg 48 that extends radially outward from the outer perimeter 34 of the middle flange 28 and bends upwardly to interconnect the middle flange 28 to an outer wall 50 that is arranged generally orthogonally with respect to the middle flange 28. Outer wall 50 includes a front portion 52 to which the lower leg 48 is attached and a back portion 54 that extends rearwardly from the front portion 52, beyond the lower leg 48. The outer wall front and back portions 52, 54 are angled with respect to each other so that each is respectively arranged substantially tangentially with respect to the portion of the middle flange outer perimeter 34 to which it is aligned. The outer wall back portion 54 is not directly connected to the lower leg 48 so that the outer wall back portion 54 is spaced from the middle flange 28, providing a gap therebetween.

Still referring to FIG. 3, each wall assembly 46 further includes an end wall 56 that is connected to and extends from a portion of the outer wall back portion 54 that is furthest from the outer wall front portion 52. The end wall 56 extends generally orthogonally with respect to the outer wall 50 and in a radial direction across the middle flange 28. A bottom edge of the end wall 56 is vertically spaced from the middle flange 28 and a curved upper perimeter edge defines the top of end wall 56. Each end wall 56 includes a dimple 58 that defines a depression extending into a surface facing toward a respective one of the bearing balls 20. The dimple 58 may be formed by a stamping procedure which stamps the dimple 58 into the respective surface of the end wall 56 and which correspondingly forms a dome 60 that extends as a convex projection from an opposing surface of the end wall 56. The dimple 58 is sized so that the bearing ball 20 (FIG. 2) nests into and is located by the dimple 58 in a resting state. An end of the spring 22 (FIG. 2) engages the opposing side of the end wall 56, concentrically outside of the dome 60.

Still referring to FIG. 3, an inner flange 62 extends upwardly from the inner perimeter 36 of the middle flange 28 and as a unitary extension of the material of the middle flange 28. The inner flange 62 includes multiple tabs 64 that extend upwardly from the remainder of the inner flange 62. Each inner flange tab 64 defines a generally triangular profile shape that is wider toward the bottom and narrower toward the top that terminates at an upper edge 66. Correspondingly, spaces that are shaped like inverted triangles are provided between adjacent inner flange tabs 64. Upper ends of the inner flange tabs 64 bend inwardly and therefore extend angularly away from the middle flange 28 and toward a central axis of the valve rotator 5 (FIG. 1).

Referring again to FIG. 2, a ring 68 sits upon the upper ends of the inner flange tabs 64 and provides an interface between the ball cage 26 and the spring disk 16 (FIG. 1). Ring 68 is made from a hardened material that is preferable harder and/or more durable that spring-type sheet metal material(s) from which the spring disk 16 and ball cage 26 are made. Ring 68 has a round cross-section as shown, but may have, for example, a flat ring configuration in other embodiments. The ring 68 facilitates sliding between the upper ends of the inner flange tabs 64 and the spring disk 16 (FIG. 1), reducing wear of such components.

Figure 4:
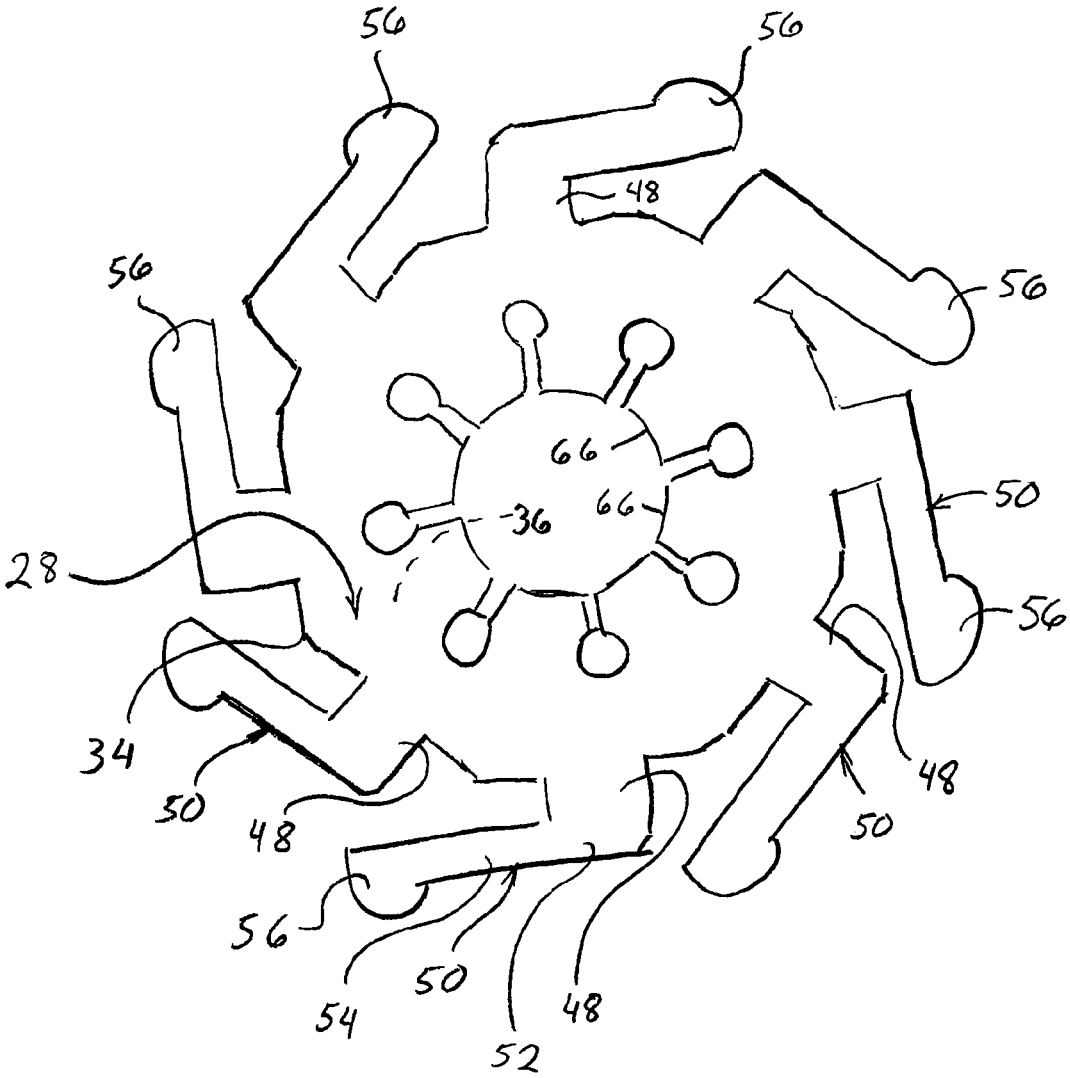
FIG. 4 is a top plan view of a blank before being formed into a ball cage.

Referring now to FIG. 4, in this embodiment, the ball cage 26 is made from a single blank 70 of the spring-type sheet metal material that undergoes stamping procedures to arrive at the use-ready form as shown in FIG. 3. In this way, all of the structures that define the boundaries of the pockets 24 (FIG. 2) are fully integral with each other and formed from a single piece of material that may be embodied by blank 70. The blank 70 or its parent material from which it was cut may be annealed into a soft annealed state. The blank 70 may undergo the stamping procedures while in such soft annealed state to form the cage assembly 26. The fully formed cage assembly 26, in its ready to use form, may be heat treated to harden the material so that the ball cage 26 is used in a hardened state.

Still referring to FIG. 4, in one method of forming the ball cage 26, the blank 70 is annealed into a soft annealed state and the dimples 58 and ramps 38 are stamped into the end walls 56 and middle flange 28. The end walls 56 are bent upwardly from the outer walls 50 and the outer wall front and back portions 52, 54 are bent so as to angle with respect to each other. The lower legs 48 are bent so as to pivot the outer walls 50 and end walls 56 to the positions shown in FIG. 3. Toward the middle of the blank 70, the upper ends of the inner flange tabs 64 are bent downwardly and the middle of the blank 70 is pressed upwardly so as to form the upwardly extending inner flange 62 as shown in FIG. 3. At this point, the blank 70 embodies the ready to use form of ball cage 26. The ball cage 26 is then heat treated to harden the material so that the ball cage 26 is used in a hardened state.

Although the best mode contemplated by the inventors of carrying out the present invention is disclosed above, practice of the present invention is not limited thereto. It will be manifest that various additions, modifications, and rearrangements of the features of the present invention may be made without deviating from the spirit and scope of the underlying inventive concept. Moreover, the individual components need not be formed in the disclosed shapes, or assembled in the disclosed configuration, but could be provided in virtually any shape and assembled in virtually any configuration. Furthermore, all the disclosed features of each disclosed embodiment can be combined with, or substituted for, the disclosed features of every other disclosed embodiment except where such features are mutually exclusive.

It is also noted that in general, term used herein correspond to orientations and positions in the FIGS. as illustrated, which may or may not correspond to end use applications. For example, structures described as overlying certain other structures in this description may in fact by underlying the same structures in an end use application, or otherwise.

I hereby claim:

1. A valve rotator comprising:

a main body segment and a body cap overlying the main body segment so that a space is defined between the main body segment and the body cap; and a ball cage assembly housed in the space between the main body segment and the body cap, the ball cage assembly including;

a middle flange having an outer perimeter and upper surface, multiple ramps that are spaced from each other and extend upwardly from the upper surface of the middle flange;

multiple wall assemblies that are connected to and extend upwardly from the outer perimeter of the middle flange, the multiple wall assemblies being circumferentially spaced from each other about the middle flange, each of the multiple wall assemblies including an outer wall and an end wall that is attached to and extends generally orthogonally with respect to the outer wall in a generally radial direction across the middle flange, the outer wall having an inner surface that faces inwardly toward the middle flange and an outer surface that faces outwardly away from the middle flange;

wherein the middle flange defines an inner perimeter thereof and the ball cage assembly further includes an inner flange that extends from the inner perimeter of the middle flange and upwardly away from the upper surface of the middle flange and further comprises a ring that is arranged between the inner flange of the ball cage assembly and a spring disk that is housed within the space that is defined between the main body segment and the body cap so as to prevent frictional engagement of the inner flange of the ball cage assembly and the spring disk;

wherein a pocket is defined between the ball cage assembly inner flange and each of the multiple ball assemblies, the pocket housing a bearing ball therein so that movement of the bearing ball in a radial direction inwardly across the middle flange is limited by the inner flange, and movement of the bearing ball in a radial direction outwardly across the middle flange is limited by the outer wall of the respective wall assembly;

wherein a spring is arranged within each pocket so that a first end of the spring engages an end wall of a first wall assembly and a second end of the spring engages the respective ball bearing and biases the ball bearing against an end wall of a second wall assembly; and wherein the end wall of each of the wall assemblies includes a depression extending into a surface thereof that faces the respective ball bearing so that the ball bearing is biased by the spring so as to nest in the depression.

2. A valve rotator comprising:

a main body segment and a body cap overlying the main body segment so that a space is defined between the main body segment and the body cap; and a ball cage assembly housed in the space between the main body segment and the body cap, the ball cage assembly including;

a middle flange having an outer perimeter and upper surface, multiple ramps that are spaced from each other and extend upwardly from the upper surface of the middle flange;

multiple wall assemblies that are connected to and extend upwardly from the outer perimeter of the middle flange, the multiple wall assemblies being circumferentially spaced from each other about the middle flange, each of the multiple wall assemblies including an outer wall and an end wall that is attached to and extends generally orthogonally with respect to the outer wall in a generally radial direction across the middle flange, the outer wall having an inner surface that faces inwardly toward the middle flange and an outer surface that faces outwardly away from the middle flange; and wherein at least a portion of the end wall of each of the multiple wall assemblies extends to a greater height than the outer wall.

3. The valve rotator of claim 2 wherein the outer wall of each of the wall assemblies defines a length thereof and includes a lower leg that interconnects the outer wall and the ball cage assembly middle flange to each other, and wherein the lower leg extends along less than the entire length of the outer wall.

4. The valve rotator of claim 3 wherein the lower leg extends along about one-half of the entire length of the outer wall.

5. The valve rotator of claim 2 wherein the end wall of each of the multiple wall assemblies has a curved upper perimeter edge.

6. The valve rotator of claim 2 wherein the end wall of each of the wall assemblies includes a depression extending into a surface of the end wall that faces a respective ball bearing that is biased by a spring into the depression.

7. A valve rotator comprising:

a main body segment and a body cap overlying the main body segment so that a space is defined between the main body segment and the body cap; and a ball cage assembly housed in the space between the main body segment and the body cap, the ball cage assembly including;

a middle flange having an outer perimeter and upper surface, multiple ramps that are spaced from each other and extend upwardly from the upper surface of the middle flange;

multiple wall assemblies that are connected to and extend upwardly from the outer perimeter of the middle flange, the multiple wall assemblies being circumferentially spaced from each other about the middle flange, each of the multiple wall assemblies including an outer wall and an end wall that is attached to and extends generally orthogonally with respect to the outer wall in a generally radial direction across the middle flange, the outer wall having an inner surface that faces inwardly toward the middle flange and an outer surface that faces outwardly away from the middle flange;

wherein the ball cage assembly further includes an inner flange that extends from the inner perimeter of the middle flange and upwardly away from the upper surface of the middle flange, the inner flange including multiple tabs that extend upwardly from the remainder of the inner flange; and wherein the tabs of the inner flange include upper ends that extend angularly away from the middle flange and toward a central axis of the valve rotator; and further comprising a ring that sits upon the upper ends of the inner flange of the ball cage assembly so that the ring is sandwiched between the inner flange of the ball cage assembly and a spring disk that is housed in the space that is defined between the main body segment and the body cap.

8. A valve rotator comprising:

a main body segment and a body cap overlying the main body segment so that a space is defined between the main body segment and the body cap; and a ball cage assembly housed in the space between the main body segment and the body cap, the ball cage assembly including;

a middle flange having a generally ring-shaped profile defined between an inner perimeter and an outer perimeter of the middle flange and opposing upper and lower surfaces;

multiple ramps that are spaced from each other and extend upwardly from the upper surface of the middle flange between the inner and outer perimeters of the middle flange;

further comprising multiple wall assemblies, each of the multiple wall assemblies including an outer wall and an end wall that are arranged with respect to a respective ramp so as to define a pocket in which a spring biases a bearing ball up the ramp; and wherein each outer wall includes a front portion and a back portion that are connected to and angled with respect to each other.

9. The valve rotator of claim 8 wherein each pocket is defined between a pair of end walls of a pair of adjacent ones of the multiple wall assemblies.

10. The valve rotator of claim 8 wherein the front and back portions of the outer walls are arranged generally tangentially with corresponding portions of the middle flange that align with the respective front and back portions.

* * * * *